US006732799B2

(12) United States Patent
Challacombe

(10) Patent No.: US 6,732,799 B2
(45) Date of Patent: May 11, 2004

(54) APPARATUS FOR STIMULATING OIL EXTRACTION BY INCREASING OIL WELL PERMEABILITY USING SPECIALIZED EXPLOSIVE DETONATING CORD

(75) Inventor: Brad J. Challacombe, Anaheim, CA (US)

(73) Assignee: Bradley J. Challacombe, Anaheim, CA (US)

( * ) Notice: Subject to any disclaimer, the term of this patent is extended or adjusted under 35 U.S.C. 154(b) by 0 days.

(21) Appl. No.: 10/041,885

(22) Filed: Oct. 24, 2001

(65) Prior Publication Data

US 2003/0075328 A1 Apr. 24, 2003

(51) Int. Cl.[7] ..... E21B 43/263
(52) U.S. Cl. ..... 166/299; 166/279; 166/311
(58) Field of Search ..... 166/299, 279, 166/311, 312; 102/275.1

(56) References Cited

U.S. PATENT DOCUMENTS 2,414,349 A * 1/1947 Alexander ..... 166/299
3,157,119 A * 11/1964 Porter ..... 102/319
3,260,201 A * 7/1966 Kelly ..... 102/275.1
3,648,612 A * 3/1972 Grayson ..... 102/319
4,316,415 A * 2/1982 Baker ..... 102/275.8
5,293,943 A * 3/1994 Williamson, Jr. ..... 166/319
5,690,171 A * 11/1997 Winch et al. ..... 166/63
6,082,450 A * 7/2000 Snider et al. ..... 166/55.2

* cited by examiner

*Primary Examiner*—David Bagnell
*Assistant Examiner*—Giovanna Collins
(74) *Attorney, Agent, or Firm*—Steins & Associates, P.C.

(57) ABSTRACT

Apparatus and method for explosive and chemical rehabilitation of existing oil wells' perforations and formation, to stimulate oil production therefrom, comprising a combination of detonating cord with a plurality of hardened steel tubes, disposed at predetermined distances thereabout, effectuating a time sequencing of the detonating cord explosions and burn rate. A high-pressure detonator, surrounded by a protective shield, which absorbs the explosive power of the detonator while preserving its desired release of kinetic energy, is used to ignite the detonating cord. An external plastic tube, adjacent to the detonating cord, is filled with oil well production enhancing chemicals such as acid etchers or paraffin dispersants, wherein upon ignition of the detonating cord, the chemicals are explosively propelled through perforations into the formation thereabout, to stimulate and chemically react therewith. A Sample basket and weight are mounted to the bottom of the apparatus. A 0.092 piano wire supports entire apparatus.

25 Claims, 8 Drawing Sheets

APPARATUS FOR STIMULATING OIL EXTRACTION BY INCREASING OIL WELL PERMEABILITY USING SPECIALIZED EXPLOSIVE DETONATING CORD

BACKGROUND OF THE INVENTION

1. Field of the Invention

The invention relates, in general, to an apparatus and method for stimulating wells, such as oil wells, to improve the production of oil therefrom, and more particularly, to an apparatus and method for increasing the transmissibility of oil from a productive oil bearing formation into which an oil well bore is drilled to increase the flow of oil, or similar fluids, from the formation into the well bore.

2. Description of the Prior Art

Oil wells have been known to produce oil for nearly seventy-five (75) years. Oil wells that have been producing oil for several years often experience a reduction in oil extraction or production as the years progress. When the oil production is reduced, remedial action in the form of stimulation to improve the oil production output of the oil well is undertaken.

Generally, such stimulation may involve improvement of the permeability or transmissibility of the reservoir itself or merely clearing the casing perforations of accumulated production-restricting contaminants, such as heavy hydrocarbons, paraffins, tars, mineral depositions, or formational fines in or near the casing perforations, by the use of vibratory explosive forces created by the ignition of a detonator and detonating cord.

Typically, the methods used to increase the transmissibility of sand, shale or rock formation are shock treatments using explosives, acid washes, hydraulic fracturing, and high energy gas fracturing.

The flow rate of a fluid such as oil through a porous medium, such as a sand, shale or rock formation, is a function of the permeability or transmissibility of that particular formation. If the transmissibility of oil from a oil bearing formational reservoir can be increased, more fluid can be recovered. It is well known that over the life of an oil or gas well, with continued pumping or removal of the oil or gas from that well, the permeability of the surrounding formation may be economically insufficient to justify continued production, even though a large percentage of fluid hydrocarbons remain. When this occurs, the oil well operator can either abandon the oil well or can attempt to increase the permeability of that formation to rejuvenate the flow of liquid hydrocarbons therethrough.

There are currently a number of techniques or processes for mechanically increasing permeability. The best known processes are: (1) hydraulic fracturing; (2) explosive fracturing; (3) acidizing, and (4) high energy gas fracturing.

Hydraulic Fracturing

Hydraulic fracturing is a process used for increasing the permeability of a rock formation by a slow introduction of a highly viscous fluid that is pumped into the area of a well bore between packings. In the hydraulic fracturing technique, the combined fluid pressure is steadily increased until the tensile strength of that particular rock material is exceeded. When this occurs, a fracture will be initiated which propagates from opposite sides of the well bore into the formation; this is known as a biwing fracture. This fracture is induced at a point of least resistance in the rock material.

A fluid used in practicing such a method is one selected to be sufficiently viscous to enable the suspension and mass transport of proppants suspended therein. Such proppant materials are either sand grains or grains of a synthetic material and are made to pass into and settle in the induced fracture. So arranged, the proppants prevent the induced fracture from totally closing once the pressure on the fluid is reduced and the normal closing pressures of the rock formation are re-exerted. Hydraulic fracturing generally involves the generation of the single biwing fracture that extends in a vertical plane from opposite sides of the well bore into the rock formation. In such fracturing, the injected fluids will, by and large, remain in the formation, and the proppants used to support the fracture may, due to compaction, actually come to restrict the permeability of that rock formation rather than enhance or improve its permeability. Another drawback to the use of hydraulic fracturing, and of major consideration in selecting a rock formation fracturing process, is the extent and expense of the equipment and labor involved, since the hydraulic fracturing method requires the use of hydraulic pumps with a high pressure capability along with the temporary positioning of a packer above the oil bearing strata.

EXPLOSIVE FRACTURING

In an attempt to overcome the limitations of hydraulic fracturing where generally only a single biwing fracture is produced, explosives have been used for dynamically loading a rock formation. Because of the speed of burning of an explosive, and the shock wave produced thereby, it has been found that explosive compaction of the formation rock around the well bore opposite the explosion may actually decrease rather than increase the permeability of the rock formation. Therefore, while explosive fracturing may provide a greater circumferencial fracturing effect in a rock formation, it may also depredate the permeability of the rock formation to the point where most, if not all, permeability is lost. Explosive fracturing has been, therefore in the past, generally considered unpredictable and unreliable.

ACID FRACTURING

Acid fracturing is a process which is utilized to increase permeability by dissolving reactive materials in a rock formation to create conductive passageways or "worm holes" and for chemically etching the oppositely disposed faces of a rock formation fracture. The acids which are frequently used are concentrated solutions of hydrofluoric and hydrochloric acid, either of which can, of course, create serious safety problems in the transportation and conveyance of such highly corrosive fluids to a desired location in an oil well bore.

Furthermore, acidizing is limited by a danger of formation matrix collapse due to excessive rock dissolution near the well bore as a consequence of a preferential invasion of the acid used into zones of high, rather than low, permeability.

Another limitation found in the use of the acidizing technique, is that the depth of penetration is limited by the type of rock in the rock formation and the degree of the strength of the acid. Many times, these acidizing processes have been found to cause extensive damage to the well bore due to the geochemical reactions produced. Therefore, the nature of the materials at the location where the fracture is to be induced must be identified prior to selection of the acid to be used. Where such unwanted geochemical reactions take place, they can create damage, leading even to a loss of permeability.

High Energy Gas Fracturing

Propellant deflagration is a recent technology that has been developed to produce a good distribution of fractures in the oil-bearing rock formation around a well bore without the problems that have been inherent in the explosive and acid processes.

In the use of high energy gas fracturing, a significant amount of high energy is created by a deflagrated propellant that is ignited in a well bore adjacent to a rock formation to be fractured. Upon ignition of the propellant in the canister, high-energy gas and other products of this combustion process, such as water vapor or steam, are driven to near sonic velocities.

The propellant can be burned radially from a longitudinal center cavity within the propellant, or can be burned from one end, as in a cigarette burn, or a combination of both processes can be employed to develop the high energy fracturing process.

In practice, high-energy gas fracturing involves the placement of a canister of a propellant adjacent to a perforated wall of a well bore in the zone where it is desired to increase the permeability of the oil-bearing rock formation. An igniter rod is then implanted adjacent to the canister containing the propellant. To ignite the propellant, an electrical current is transmitted over one or more electrical wires from the surface above the entrance to the oil well bore to instantaneously detonate an electric blasting cap which initiates deflagration thereof in a period of milliseconds. Once deflagration occurs, a high volume of pressurized gas and water is generated at near sonic velocities. By such deflagration, the energy loading in the oil well bore will be propagated much faster than that which occurs during hydraulic fracturing. Such an increase in the propagation speed of the energy loading produces multiple fractures in directions other than in the plane of least resistance through the oil-bearing rock formation surrounding the oil well bore. The propellant is selected from a group of propellants which will burn at a far slower rate than those propellants used for typical explosive detonations. No destructive shock wave will, therefore, be generated in a propellant deflagration which would cause crumbling of the material around the well bore.

The present invention overcomes the difficulties and problems inherently found in the prior art. To this end, these prior art problems have been overcome by the present invention, providing a new, unique and relatively foolproof, and comparatively inexpensive apparatus and method for rejuvenating and bringing, as it were, "old mature" oil wells back into meaningful and cost-effective oil production.

SUMMARY OF THE INVENTION AND OBJECTS

Fundamentally, the basic invention herein is an apparatus and method for increasing the permeability of a productive oil formation about an existing oil well bore to stimulate oil extraction therefrom, comprising a combination of a high pressure detonator igniting a detonating cord with a plurality of hardened steel sleeves thereabout, disposed in a spaced apart relationship at predetermined distances along the detonating cord to effectuate time sequencing of the detonating cord explosions, and the explosive gas propagation/burn rate generated thereby within the oil well bore. An external plastic tube, arranged to be adjacently disposed to the detonating cord and pressure compensators, is filled with special chemicals such as paraffin dispersents, and granulated chemicals containing chlorine, or the like, such that upon ignition of the detonating cord, the granulated chemicals are explosively propelled through the clogged perforations in the oil well casing and into the coagulated geologic formation thereabout to chemically react therewith to promote oil flow therethrough.

Additionally, a protective shield is mounted about the high-pressure detonator for absorbing the shock effect of the detonator when ignition of the detonator occurs in the oil well casing while, at the same time, the kinetic energy force effectuated by the explosion of the detonator is substantially preserved. A Sample/Junk basket and weight are mounted to the bottom of the apparatus to capture formational material for analysis, debris created by the detonation of the detonator and the detonating cord, and drives the entire combination into the typical highly viscous fluid found in oil wells. A 0.092 diameter support wire, to which the detonating cord, detonator, pressure compensators, external plastic tube containing chemicals, Sample/Junk basket and weight are all secured, serves as the back-bone for the apparatus.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the United States Patent and Trademark Office, the public generally, and especially the scientists, engineers and practitioners in the art who are not familiar with patent or legal inspection, the nature and essence of the technical disclosure of the application. The abstract is neither intended to define the invention of the application, which is measured by the claims, nor is it intended to be limiting as to the scope of the invention in any way.

It is one object of the present invention herein to provide an apparatus and method for increasing oil production in existing oil wells which embodies many novel features that result in a new apparatus and method for enhancing oil production in existing oil wells which is not anticipated, rendered obvious, suggested, or even implied by any of the prior art cleaning devices, either alone or in any combination thereof.

Another and further object and feature of the instant invention disclosed herein is to provide an apparatus and method for stimulating oil production in a pre-existing oil well utilizing an explosive detonating cord, producing an explosive series of charges which are characterized by a series of sequenced, pressure controlled explosive pulses having predictably known pressure-time characteristics of determinable durations.

An even further object and feature of the instant invention disclosed and described herein is to provide a new apparatus and method for increasing the oil production of an existing oil well, while simultaneously overcoming some of the disadvantages normally associated therewith.

It is a still further primary and important feature and object of the present invention to provide an apparatus and method for stimulating oil well production, utilizing an explosive gas generating charge, which produces a pulsating gas pressure-volume wave.

Another important and primary feature of the present invention is to provide an external plastic tube, arranged in adjacent disposition to the detonating cord and pressure compensators, filled with special chemicals such as paraffin dispersents, such as granulated chemicals containing chlorine, or the like, wherein upon the ignition of the detonating cord, the granulated chemicals are explosively propelled through the clogged perforations in the oil well casing and penetrate into the wells surrounding coagulated geologic formation, to chemically react therewith to promote oil flow therethrough.

These, together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated preferred embodiments of the invention.

BRIEF DESCRIPTION OF THE DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the Claims section annexed hereto; and accordingly, a better understanding of the invention and the variant uses is intended, by reference to the drawings, which are considered as primarily exemplary and not to be therefore construed as restrictive in nature.

The invention will be better understood and objects other than those set forth above will become more readily apparent from the following description. Such description makes reference to the accompanying drawing which.

DETAILED DESCRIPTION OF THE PREFERRED EMBODIMENTS

Figure 1:
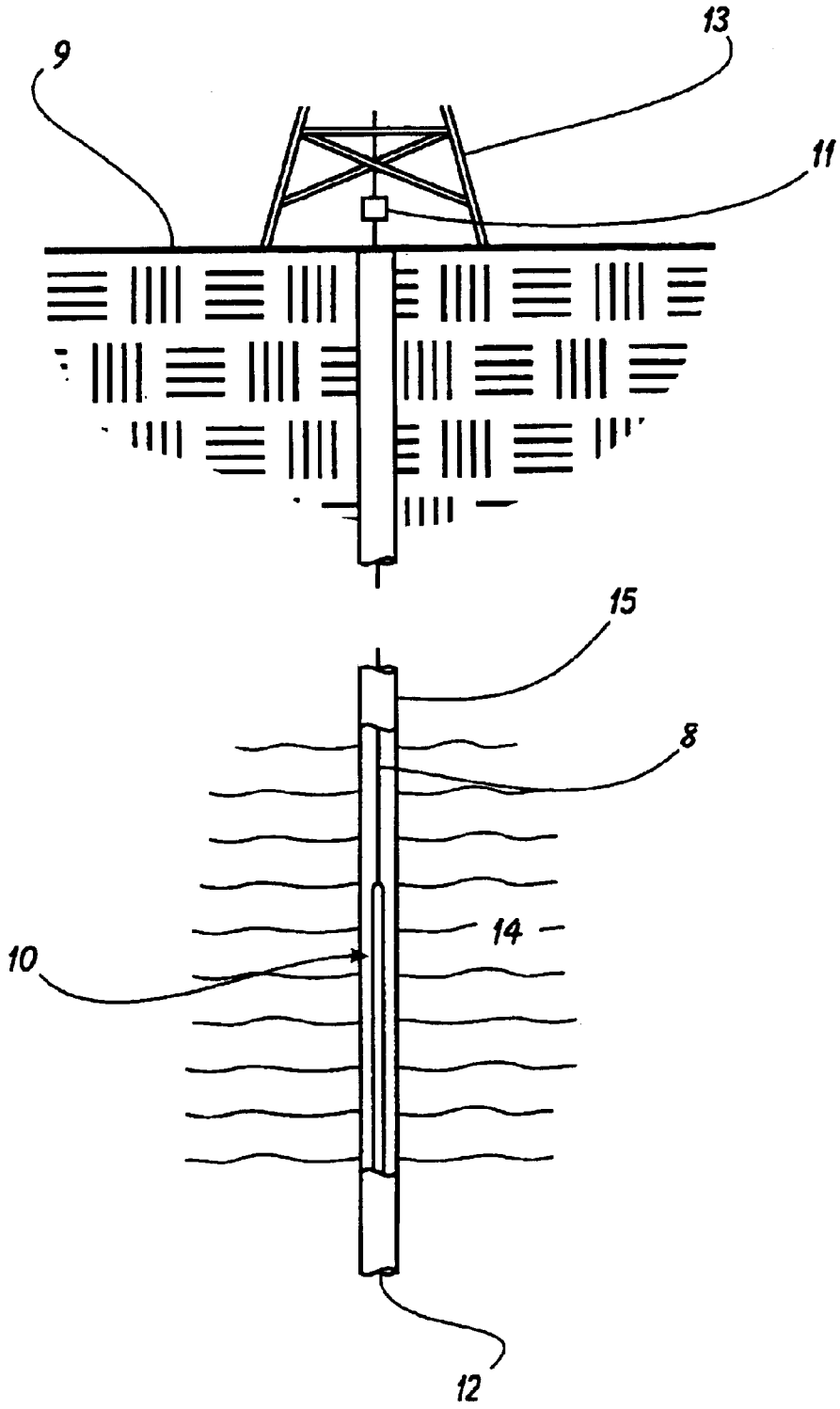
FIG. 1 depicts a longitudinal section of an oil well, with an oil well derrick, an oil well casing which is disposed down into the geologic oil bearing zone.
Figure 2:
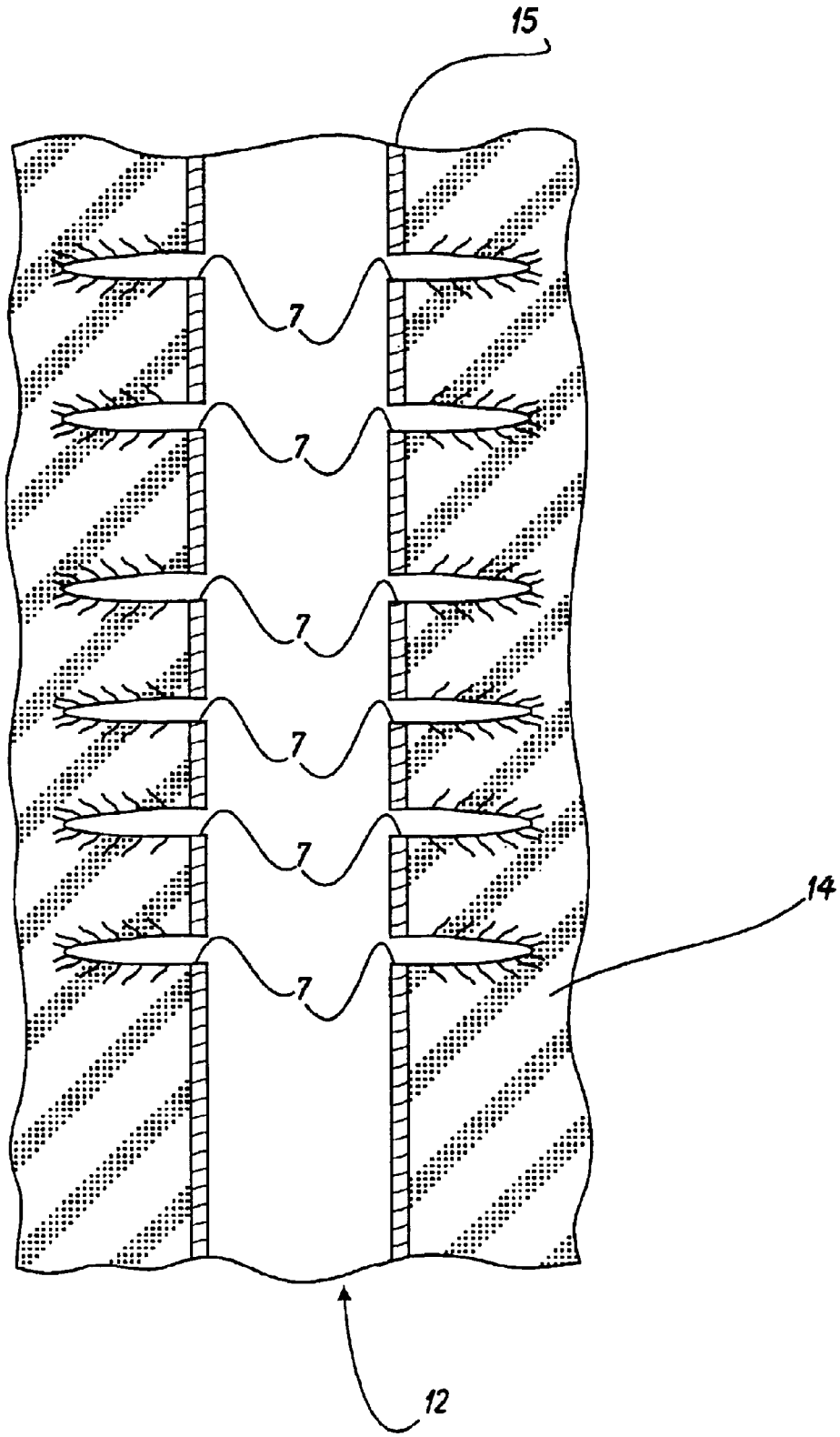
FIG. 2 is an enlarged, cross-section portion of the existing oil well of FIG. 1 illustrating the oil well casing with perforations therethrough to allow the oil from the oil-bearing geologic strata to enter into the oil well casing to be pumped therefrom.
Figure 3:
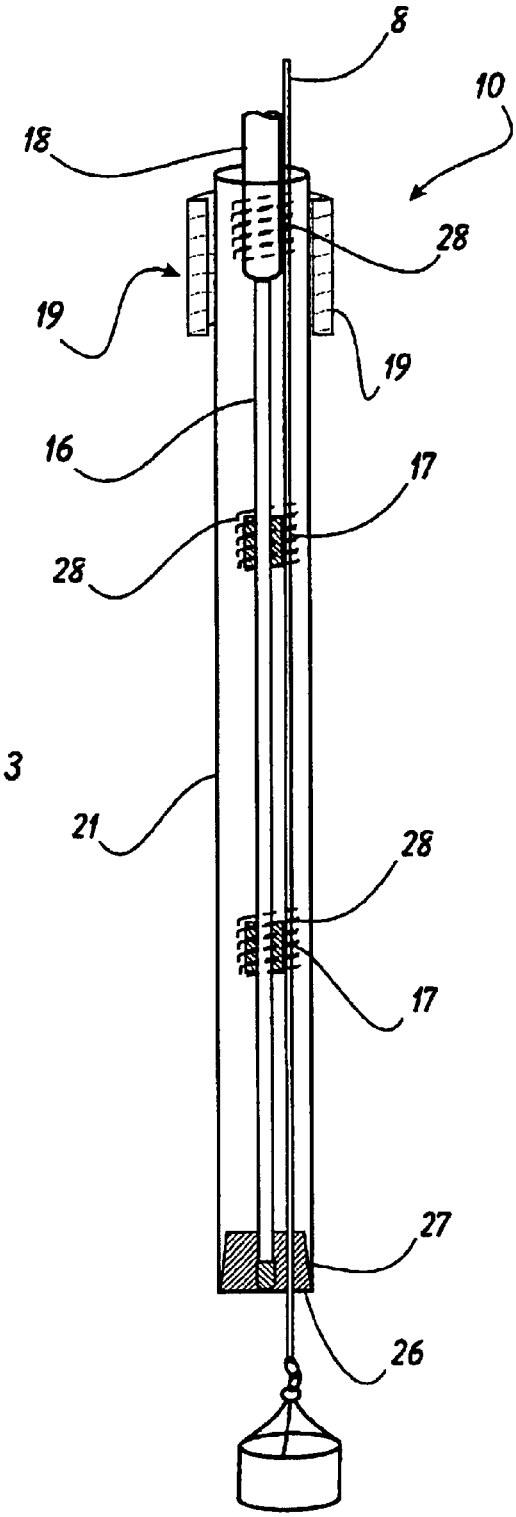
FIG. 3 is a vertical suspended view of the preferred embodiment of the present invention described hererin employing a protective shield about the detonator, which ignites the desensitized detonating cord. The protective shield dampens the potentially harmful explosive power of the detonator to the oil well casing, while utilizing the kinetic energy created by the detonator. A transparent plastic tube containing chemical material, surrounding the detonating cord which, is explosively propelled through the oil well's perforations and into its surrounding geologic formation, when the detonator ignites the detonating cord.

With special reference and emphasis now on FIGS. 1, 2 and 3 of the Drawings herein, there is shown and described both the method and apparatus of the instant invention 10 described herein. An oil well derrick 13 is mounted on the ground surrounding the oil well 12 bore. An electrical control box 11 is mounted to a wire assembly 8 which is lowered into the casing 15 of an oil well bore 12. The oil well bore 12 is drilled using the oil well derrick 13 as a drilling platform. Once the oil well bore 12 is drilled into an oil-bearing geologic reservoir 14, an oil well casing 15 is driven into the oil well bore 12. The casing 15 is then perforated using casing perforation devices. Once this occurs, the oil from the oil-bearing geologic zone 14 begins flowing into the oil well casing 15 through the perforations 7 (see FIG. 2) in the oil well casing 15. The oil is then pumped up to the surface and stored in large containers awaiting transportation to an oil refinery.

After a period of time, the oil well perforations 7 become clogged as the heavy hydrocarbon ladened oil, along with other contaminants, begins to bridge or plug off the perforations 7 in the oil well casing 15 and surrounding formation 14. At some point in time, because the perforations 7 are reduced in size and the transmissibility of oil through the formation 14 is reduced, the amount of oil being pumped out of the oil well bore 12 is significantly reduced, and, sometimes, stops altogether. When this occurs, there is a need to redevelop the productive portion of the oil well casing 15.

In FIG. 1 and 2 there is shown the present invention 10 which is guided into position within the oil well casing 15 by means of a support wire 8. One way of clearing these clogged perforations in the oil well casing is by the mechanical stimulating force of a mild, controlled series of explosions. The kinetic energy and gas pulse/delay forces created by these time-controlled explosions act to clear the material clogged in the perforations 7 and stimulate the surrounding formation 14.

An enlarged view of a partial vertical cross-section of the perforated portion of the oil well casing 15 mounted inside an oil well bore 12 is shown in FIG. 2. The perforations 7 are created in the oil well casing 15 typically by lowering a casing perforation tool (not shown) down into that portion of the oil well casing 15 which is contiguous to the oil-bearing geologic zone 14. The casing perforation tool is then activated and the oil well casing 15 is perforated by such explosive means to create a pattern such as illustrated in FIG. 2.

Turning now to FIG. 3, the present invention, generally indicated at 10, is shown and illustrated, described as an apparatus and method for increasing the permeability of a productive oil formation 14 about an existing oil well bore 12 to stimulate oil extraction therefrom. The system comprises a combination of a desensitized detonating explosive cord 16 and a plurality of hardened steel sleeves 17 thereabout functioning as pressure compensators 17 wherein the sleeves 17 are disposed in a spaced apart relationship at pre-determined distances along the length of the detonating cord 16 to effectuate time sequencing of the detonating cord 16 explosions and the explosive gas propagation/burn rate within the oil well bore 12, a non-desensitized high pressure detonator 18 for igniting the desensitized detonating cord 16, a protective shield 19 mounted about the high pressure detonator 18 for reducing the shock effect of the detonator 18 when detonation occurs in the oil well casing 15 while preserving the kinetic energy force effectuated by the detonator 18, an external plastic tube 21 arranged to be adjacently disposed to the detonating cord 16 filled with special chemicals such as paraffin dispersents, including non-liquid, granulated chemicals containing chlorine, or the like, wherein upon ignition of the detonating cord 16 the granulated chemicals are explosively propelled through the clogged perforations 7 in the oil well casing 15 and into the geologic strata 14 thereabout to chemically react therewith to promote oil flow therethrough by increasing the permeability of a productive oil formation 14 about an existing oil well bore 12 to stimulate oil extraction therefrom. The system further includes a Sample/Junk basket 22 affixed to the bottom of the apparatus 10 to catch formational material for analysis and debris from the expended apparatus 10. A sixty (60) pound weight 64 is affixed to the bottom of the Sample/Junk basket 22 to drive the apparatus 10 through the highly viscous environment often encountered in an oil well bore 12. A support wire 8, to which the detonating cord 16, detonator 18, pressure conpensators 17, chemical filled plastic tube 21, the Sample/Junk basket 22 and sixty (60) pound weight 64 are secured serves as a back-bone for the apparatus 10.

Prior Art Steel Tubes or Pressure Compensators

In the past, steel tubes have been used about detonating cord 16, but did not function as does the present invention. The old, prior art steel tubes had wall thicknesses of approximately one-sixteenth (1/16) inch, with a nominal length of three (3) inches, and formed of steel material, typically having a Rockwell hardness of approximately twenty (20). Use of the old prior art steel tubes more often than not resulted in fragmentation of the steel tubes when the detonating cord 16 was detonated, with the result that the bottom of the oil well bore 12 was littered with steel fragments and pieces of the plasticized detonating cord 16 jacketing as well. Such debris is not desirable because it can impede the operation of the oil well pump, thereby reducing production.

The distance between each of the pressure compensators or steel tubes 17 is nominally seven (7) feet from the end of the last steel tube 17 to the top of the next steel tube 17 on a one-hundred (100) foot prior art device 16, and nominally nine (9) feet on a two-hundred (200) foot prior art device.

The New Steel Tubes or Pressure Compensators

The new steel tubes 17 used in the present invention typically have a wall thickness of one-eighth (1/8) inch to five thirty-seconds (5/32) inch, with a nominal length of three (3) inches, and are tempered or carbonized to obtain a Rockwell hardness of sixty (60) or higher. As a result and consequence of this new design, these new steel tubes 17 do not fragment, remain intact and retain the majority, if not all, of the plasticized jacketing of the expended detonating cord 16.

In the event that any debris is produced due to the explosion of the detonating cord 16 in the oil well bore 12, the Sample/Junk basket 22 disposed at the bottom of the entire apparatus 10 to capture such debris.

The distance between each of the pressure compensators or steel tubes 17 is nominally five (5) feet from the end of the last steel tube 17 to the top of the next steel tube 17, in both the one-hundred (100) foot and two-hundred (200) foot devices.

Figure 12:
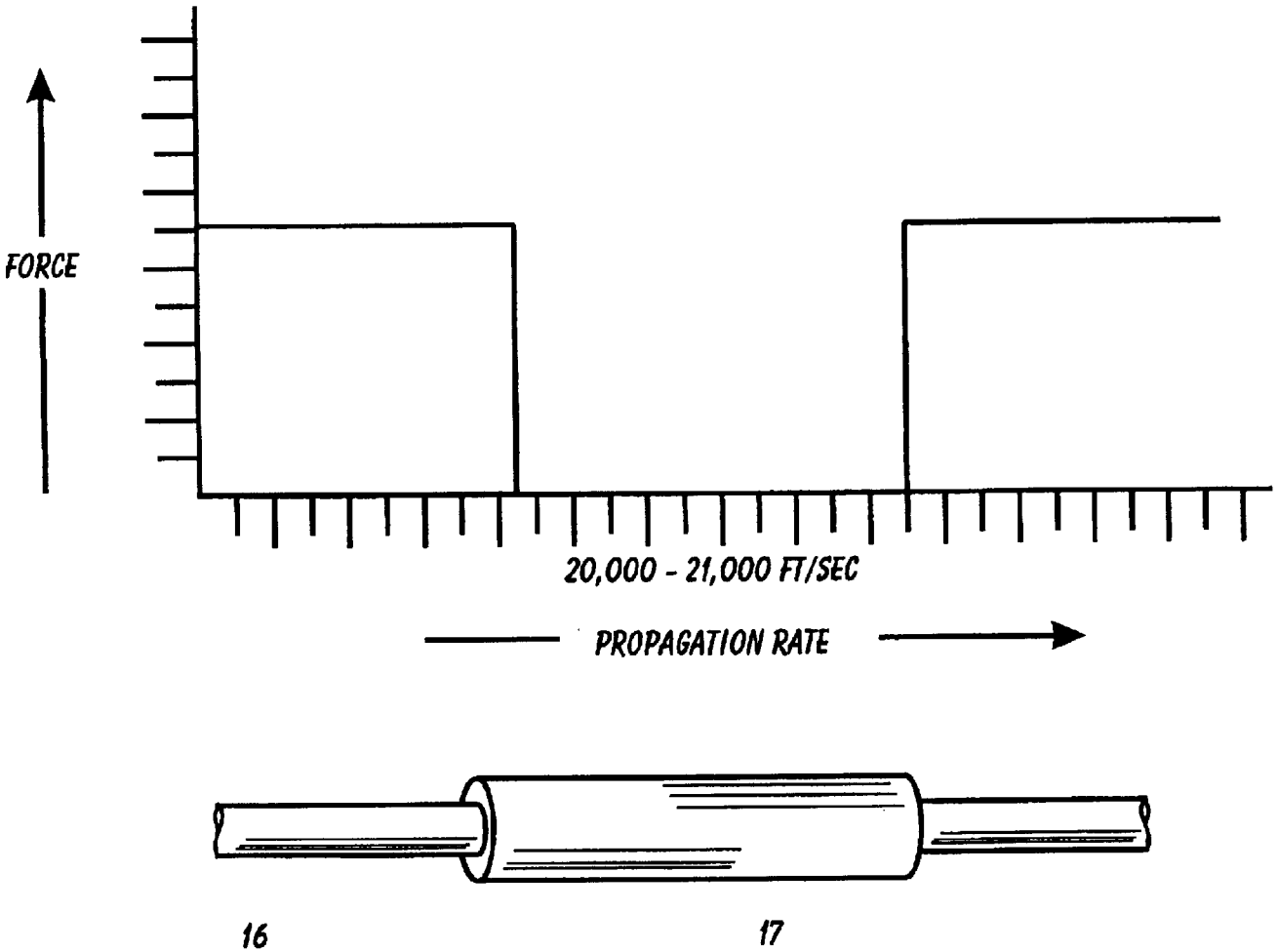
FIG. 12 illustrates a portion of the detonating cord and a pressure compensating hardened steel tube of the present invention combined with a graph illustrating the magnitude of the explosive force generated by the detonating cord and the zero pressure being contained within the pressure compensator and, as the detonating cord burns beyond the pressure compensator; the explosive force again is exerted on the oil well casing as the propagation rate of the detonating cord progresses per unit rate (time).

These methods and devices also represent a means for creating a plurality of pressure-volume pulses superimposed on the main pressure-time profile as illustrated in FIG. 12, which keep the pressure-time profile within the desired limits, notwithstanding the wide range of propagation strengths possible.

In addition, each oil well presents a further variation in parameters with respect to temperature and viscosity of crude oil being recovered. In some wells, the crude oil is recovered at relatively low temperatures but has a high viscosity comparable to axle grease, while in other wells, at the same temperature, the crude oil flows much more freely. In still other wells, the crude oil temperature is relatively high at the recovery zone or strata allowing it to flow more freely even though its viscosity may be high.

It is apparent that required stimulation of a well may be limited to opening of the slots or perforations 7 in the oil well casings 15, or it may be required to stimulate the oil bearing geologic formation 14 itself.

The actual explosives used are PETN (Pentaerythrite tetranitrate) mixture, encased in textile braid, followed by a plastic jacket, then outer textile yarns cross-countered in a close weave, which is measured in grains per foot. It has been discovered that pressure pulses, created by the detonating cord burn rate is approximately fifteen thousand (15,000) to twenty-three thousand (23,000) feet per second, depending on the detonating cord used, as is shown in FIG. 12. This is believed to be the optimal burn rate for the detonating cord 16 which will clear the perforations 7 of the oil well casing 15 and not fracture the steel tubes 17 acting as pressure compensators to create a pressure pulsing effect along the entire length of the detonating cord 16.

When the energy, speed and density determination has been matched to the required depth/head well characteristics, and to the capacity of the formation, to absorb the impulse without extraneous damage to the well casing 15 and the oil well bore 12, it is important that the gas generating means be conveyed to the oil well's geologic zone 14 in an undisturbed fashion.

Pressure Control

Control over the pressure-time profile, as illustrated in FIG. 12, in the present invention 10 is critical from the standpoint of remaining within the maximum permissible pressure range necessary to perform a useful function.

Pulsating Pressure Pulse

When an elongated gas generator system is activated under a hydrostatic head, the gas pressure must first rise to overcome the combined bursting pressure of its container and the hydrostatic pressure of the surrounding fluid. Gas generators of the prior art depend upon propagating minimal shock pressure at high velocity, reached within microseconds. The controlled, slower propagation characteristics, incorporated in the present invention 10, result in gas pressure that rises in terms of milliseconds or slower. As this overpressure is imparted to the surrounding fluid, the pressure is communicated at the velocity of sound in all directions within the fluid, declining in magnitude as the propagation distance increases, typically a function declining as the square of the distance between the starting point and the successive distance points as the gas pressure travels further away from the generating source.

It has been found that stimulation for several types of oil well conditions is enhanced by this pulsating pressure rather than by the use of a uniform gas pressure application of one longer pressure-volume pulse.

The internal gas pressure is limited to that of the detonating cord 16 gas pressure, created simply by the burning of the detonating cord within the tempered metal sleeve 17. This gas pressure, created by burning, is inadequate to burst the tempered steel sleeve 17 rather than proceeding to the rapid liberation of gas in a unrestrained detonating cord 16 explosive gas propagation. If, however, the tube 17 splits, the accumulated high pressure gas is released and immediately induces a back-pressure by the fluid on the tube 17 preventing further splitting. During each cycle, a portion of the energy is expended in the surrounding oil well casing 15, its perforations 7 and the geologic oil-bearing formation 14.

As the detonating cord 16 explosive gas generator system is increased in relation to the oil well bore 12, the opportunity for radial gas expansion is reduced and expansion of the gas volume takes place by compression and oscillation of the well fluid in the direction of the oil well bore 12 axis and out into the oil well's surrounding formation 14.

The method and apparatus of the present invention 10 employs a much simplified, inexpensive apparatus to create a wave of radially, outwardly directed pressure, within a section of the oil well casing 15 that is to be enhanced for production, and causes this pressure to travel longitudinally along the length of the casing 15.

However, the power of such a pressure wave provided from a length of unmodified detonating cord, for example, is sufficient to cause severe damage to the oil well casing 15 itself. Therefore, according to a feature of the present invention 10, the pressure wave is suitably modified so as to provide a repetitive pressure action that is delayed, attenuated, or interrupted at specific intervals throughout the length of the desensitized detonating cord 16 as shown in FIG. 12. More specifically, as the pressure wave travels along the length of the oil well's casing 15, its outward force is systematically attenuated, being restrained by microdelay devices in the form of high strength tempered steel restrictor sleeves 17, which encircle equidistant sections of the desensitized detonating cord 16 along the length thereof. In effect, as the explosive gas generated pressure wave is propagated longitudinally throughout the length of the oil well's casing 15, it is repetitively delayed or interrupted. This pressure pulsing operation is achieved by the relatively simple and inexpensive apparatus illustrated in the drawings of the invention 10 herein.

As shown in FIG. 3, the apparatus of the present invention 10 includes separate sections of pressure compensators 17 formed of hardened steel tubing. Surrounding the entire apparatus is an exterior tube 21 typically formed of polyvinyl chloride filled with a chemical material having a selected rate of dispersion. At present it is preferred to employ a customized, desensitized, double-jacketed detonating cord 16 consisting of explosives known as PETN (Pentaerythritol tetranitrate).

Mounted on the detonating cord 16, and longitudinally spaced from each other, are a plurality of microdelay devices in the form of high strength steel tubes or pressure compensators 17 which are taped securely in their desired or selected positions along the length of the detonating cord 16. The pressure compensators in the form of steel tubes 17 are spaced from one another at suitable, selected intervals.

High Pressure Detontor and Sealant

One of the significant features and characteristics of the present invention 10 is the use of a modified high-pressure detonator 18 to ensure the proper ignition and operation of the detonating cord 16, regardless of the harsh surrounding environmental conditions about the present invention 10. High pressures and temperatures along with mixed chemicals make up the operational environment often encountered by the present invention 10. Accordingly, in order to insure reliable operation of the explosive device, namely, the detonating cord 16, a high-pressure detonator 18 must be used. The connection between the detonator 18 and detonating cord 16 is sealed, using a water proof tar-like petroleum based sealant surrounded by a rubber based tape 28.

Anatomic Propagation Re: Detonating Cord and Compensator

The developer of the detonating cord 16, Ensign Bickford, discovered that when a retaining structure, having a burst strength greater than that of the outward explosive force of the detonating cord 16, the burn rate of the detonating cord 16 is slowed. As noted in the graph shown in FIG. 12, the burn rate of desensitized detonating cord 16 varies between fifteen thousand (15,000) feet per second and twenty-three thousand (23,000) feet per second. However, in six (6) individual speed tests, consecutively timed in equal one-third (⅓) sections, with and without pressure compensators, the pressure compensators slowed the burn rate. Recent tests performed, on behalf of the inventor in May 2000, with a standard PETN based detonating cord, with a burn rate between twenty-one thousand (21,000) feet per second and twenty-three thousand (23,000) feet per second, indicate the microsecond delaying system to be accurate. The burn rate is slowed from twenty-three thousand (23,000) feet per second to nineteen thousand (19,000) feet per second. Four thousand (4,000) feet per second is approximately one-fifth (⅕) of twenty-three thousand (23,000) feet per second, which is approximately a one hundred (100) microsecond delay, per calculation.

As to a further discussion of the manner of usage and operation of the present invention 10, the same should be apparent from the above description. Accordingly, no further discussion relating to the manner of usage and operation will be provided.

Direct Chemical Placement

To greatly enhance the clearing and cleaning of an oil well casing 15, and the perforations 7 therethrough, in addition to the application and use of controlled explosive shock waves and a gas pulse/delay system as herein discussed and explained in the use and application of the present invention 10, active chemical means must be used to eliminate the mineral or petroleum based agglomerations formed as a combination of pumping the oil and various elements dispersed in the oil and in the surrounding geological formation 14. Over a period of time and use, the perforations 7 in the metal casing 15 of the oil well bore 12 tend to become clogged and even become totally blocked to the passage of oil and oil combinations of fluids and semi-solids dispersed in the oil well bore 12, oil well casing, and the perforations 7 in the oil well casing 15. In the prior art, following conventional shock treatments or other mechanical treatments designed to mechanically or acoustically clear the perforations 7 in the oil well casing 15, chemicals are then mechanically pumped into the oil well bore 12 and pressurized to force the chemicals into the materials clogging the perforations 7 in the oil well casing 15. Such prior art methodologies are expensive and time-consuming for various reasons. One reason is that two separate oil well services are required. Another reason is that a substantial amount of ancillary equipment is necessary in order to pump large amounts of chemicals into the oil well bore 12. Additionally, following the pumping of the chemical cleaning material, usually, depending on the character of the oil and material being pumped out of the particular oil well bore 12 in question, a caustic (basic) or acidic liquid must then later be neutralized or extracted from the liquid being pumped out of the oil well bore 12.

Pre-Filled and Sealed Tube with Chemical Dispersant and Externally Mounted to Support Wire and Detonating Cord for Clearing/Stimulating Oil Well Casings The inventor herein has discovered a new apparatus and method 10 for acoustically and chemically clearing and stimulating an oil well casing 15 and the perforations 7 therethrough which provide access to the oil-bearing geologic strata 14. Such new and unique apparatus and method 10 used herein previously mentioned and described apparatus and method for acoustically stimulating an oil well, using a special combination of detonating cord 16 and a plurality of pressure compensators 17 for both controlling the magnitude of the explosive force on the oil well casing 15, and for producing a pulsing effect of the explosive shock waves created by the exploding detonating cord 16.

Figure 5:
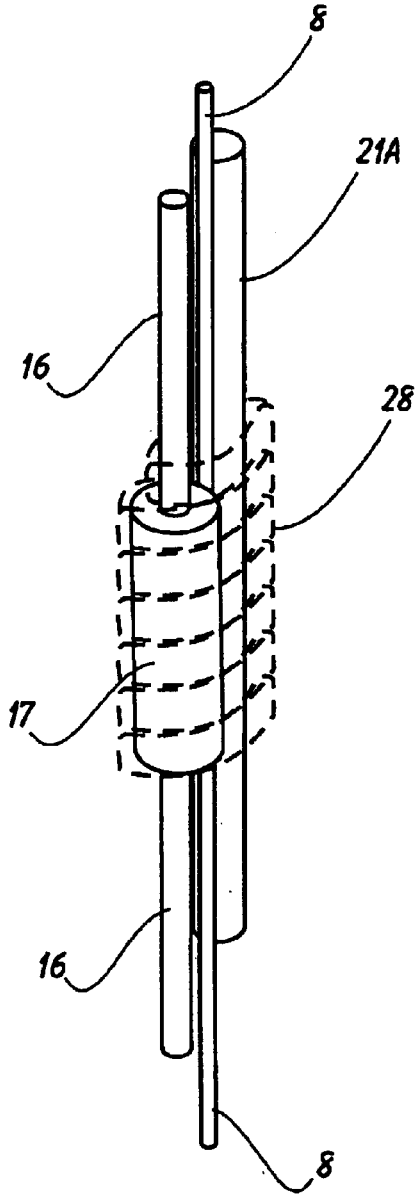
FIG. 5 is an enlarged partial view, shown partially in section, of the pressure compensator mounted to the detonating cord and outside plastic tube containing chemicals for cleaning the oil well. Both the pressure compensator and the plastic tube are mounted to each other and a support wire.
Figure 4:
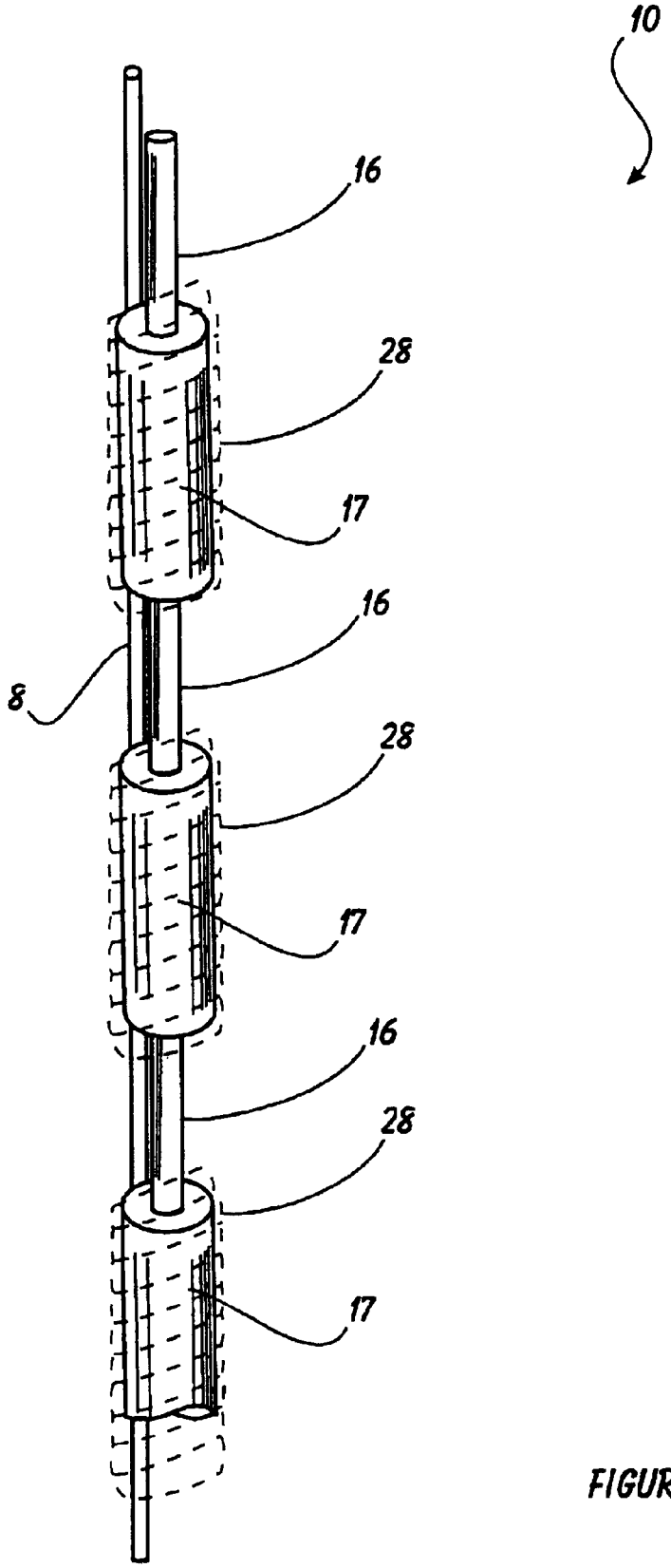
FIG. 4 is a view of a portion of the preferred embodiment of the present new and novel apparatus of the invention described herein, including a plurality of pressure compensators mounted on the desensitized detonating cord, each of the pressure compensators being wrapped with a length of plastic tape and secured thereby to the support wire for guiding the detonating cord into the oil well to be stimulated.

As shown and illlustrated in FIG. 3, a plastic tube 21 is placed about the desensitized detonating cord 16, the pressure compensators 17 mounted and secured about the detonating cord 16, and mechanically affixed to the support wire 8 as shown and illustrated in FIG. 3. In FIG. 5, there is shown and illustrated the plastic tubing 21A, secured adjacent to the entire explosive apparatus. The plastic tube is approximately a one-fourth (¼) inch to one (1) inch inner diameter, with a one thirty-second (1/32) inch wall thickness and having a length approximately equal to the cleaning device which ranges from approximately fifty (50) feet to two hundred (200) feet in length. The ends of the plastic tubing can be sealed with a neoprene plug 27 or can be sealed by folding the bottom end 26 of the tube 21 and heat-sealing, or the like, to ensure that the chemical materials are retained in the plastic tubing 21. The outside diameter of the tubing 21 should be approximately one-fourth (¼) inch to one (1) inch. Typically, the oil well casing 15 inside diameter is four (4) inches. The plastic tube 21 is filled with either a paraffin dispersent, granulated or liquid, hydrochloric acid (HCL) a.k.a. muriatic acid, sulfamic acid or Tetra Hydrochloride This plastic tubing 21 could be heat-shrink tubing.

Once this is done, and the entire combination 10 is then lowered to the desired position in the oil well casing 15 to be stimulated, the entire invention 10, along with the plastic tubing 21 and the acid granules or liquid, the detonator 18 is electrically ignited by a remote-controlled electric control mechanism (not shown) and the detonator 18, in turn, sets off the detonating cord 16, which explodes adjacent to the plastic tubing 21 containing the acid compound. Not only does the shock effect of the timed and spaced explosive forces, which occur along the detonating cord 16, help to stimulate coagulated formations and enhance the permeability thereof to increase the flow of oil through the now-stimulated oil well casing 15 perforations 7, but also the concentrated chemicals are driven directly through the perforations 7 into the oil bearing formation 14 where they are time released and most effective, reacting within the surrounding formation 14 to enhance the permeability thereof.

This new and unique combination provides a "one-two" punch in the enhancement of the permeability of an existing oil well and would eliminate the need for a more costly second operation, such as conventional acidizing.

Protective Shield Covering Detonator

Figure 8:
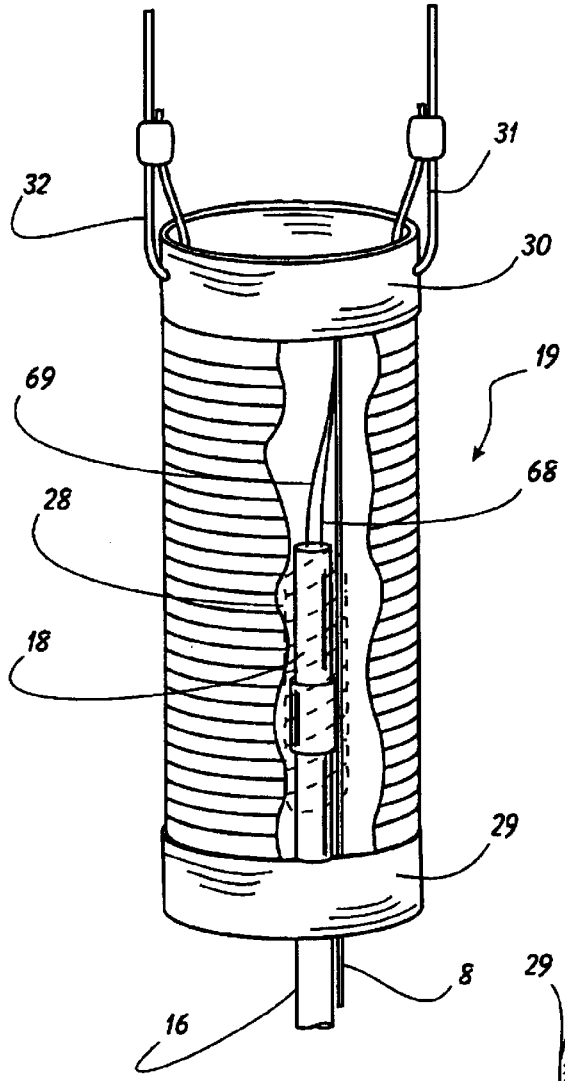
FIG. 8 is a vertical, partial cutaway view of a portion of the present invention with a protective shield, a detonating cord, an igniting detonator, and a support wire.
Figure 10:
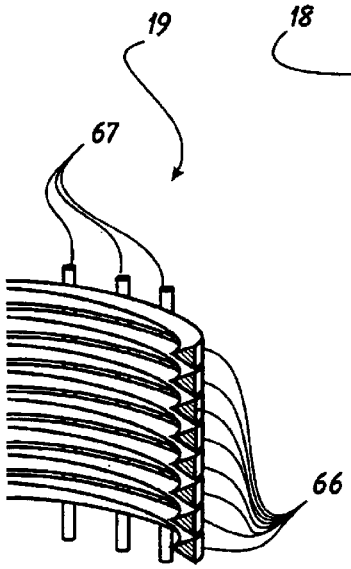
FIG. 10 is an enlarged, partial cutaway portion of the view A—A of FIG. 8.
Figure 9:
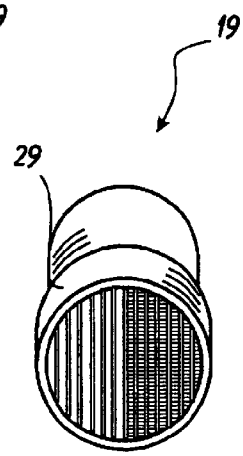
FIG. 9 is a perspective view of the bottom end of the protective shield of FIG. 8.
Figure 11:
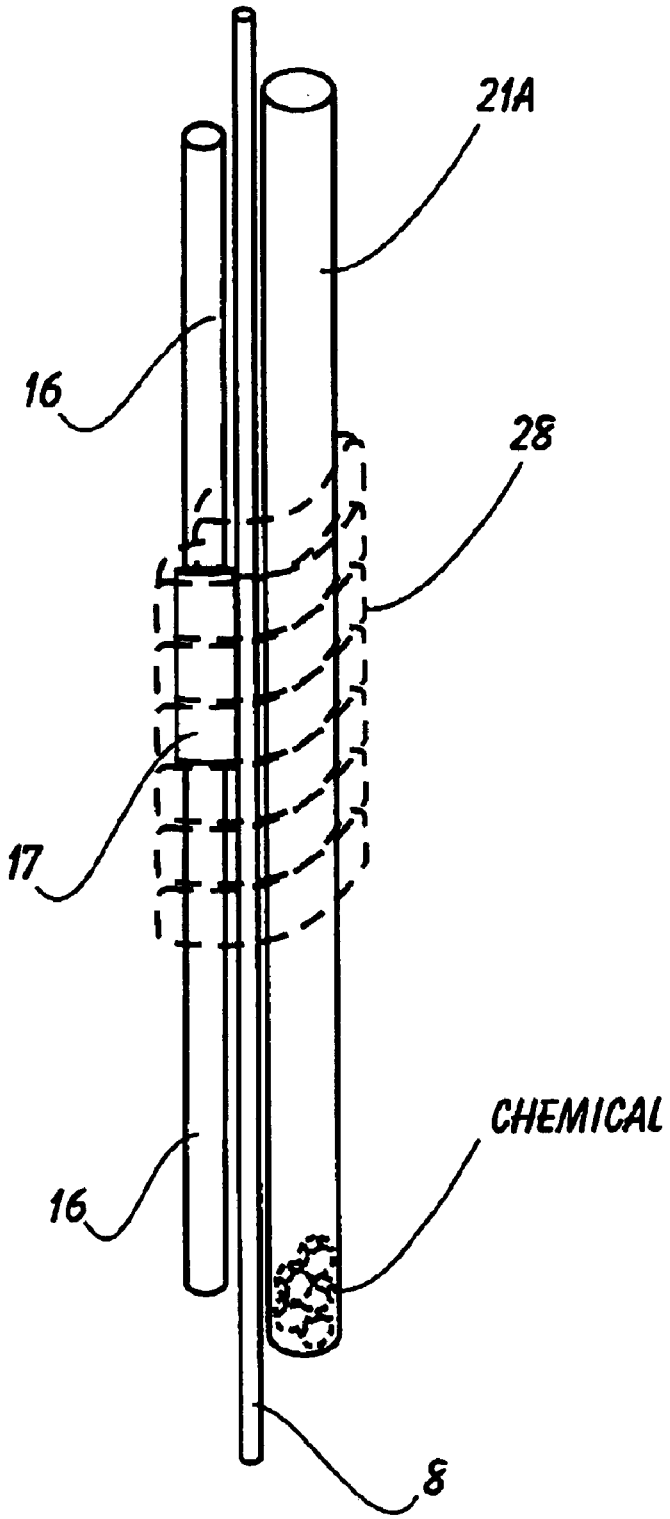
FIG. 11 is an another view of a portion of the invention herein showing the support wire, the detonating cord, a pressure compensator and the plastic tube filled with chemicals to disperse the material clogging the oil well. Plastic tape is wrapped about all of these elements to hold them together.

With continuing reference now to all of the drawings herein, and with special emphasis now on FIGS. 8, 9, and 10, there is shown and described a protective shield, generally shown at 19, which consists of a two and one-half (2½) inch outer diameter, fifty thousandth (50/1000) slot stainless steel screen, seven and one-half (7½) inches in length, equipped on both ends with hardened steel rings 29 and 30, three quarter (¾) inch wide, with a wall thickness of one-eighth (⅛) inch.

In operation, the protective shield 19 is suspended in place over the detonator by one-eighth (⅛) inch cables 31, 32 approximately six (6) inches in length. The purpose of the protective shield 19 is to utilize the kinetic energy generated by the detonator 18, while dampening the detonators 18 explosive force, thus protecting the oil well casing 15 from the initial impact of the explosive force created by the ignition of the detonator 18.

The Sample/Junk Basket Attached to Bottom of the Supprot Wire

Figure 6:
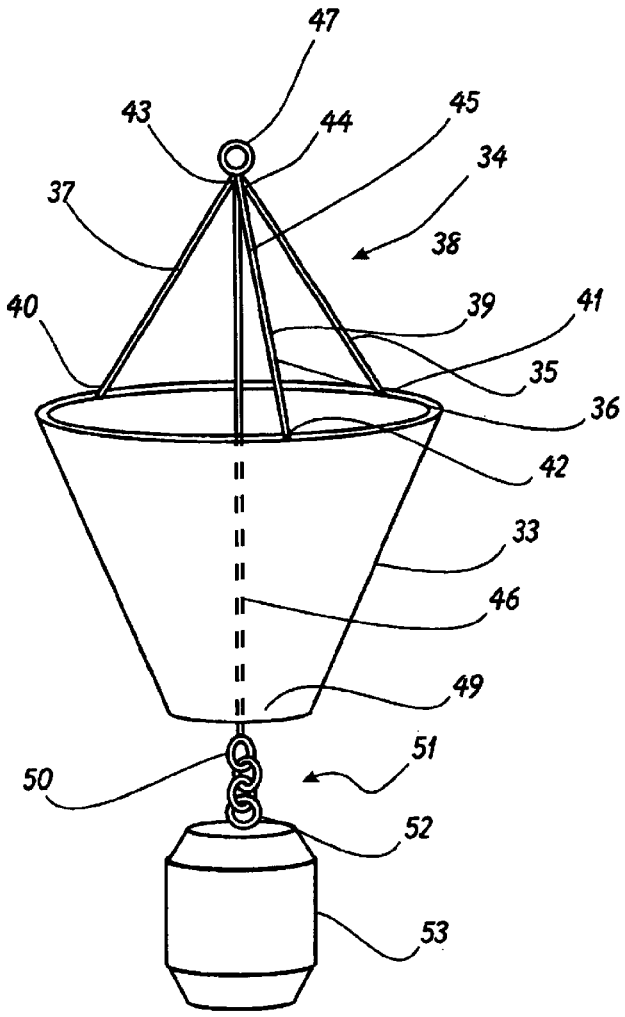
FIGURE 6 PRIOR ART
FIG. 6 is a view of the prior art configuration of the Sample/Junk basket mounted to the bottom end of the 0.062 diameter support wire with a fourteen-(14) pound weight attached thereto to maintain the combination support wire and detonating cord in a relatively straight vertically disposed arrangement.
Figure 7:
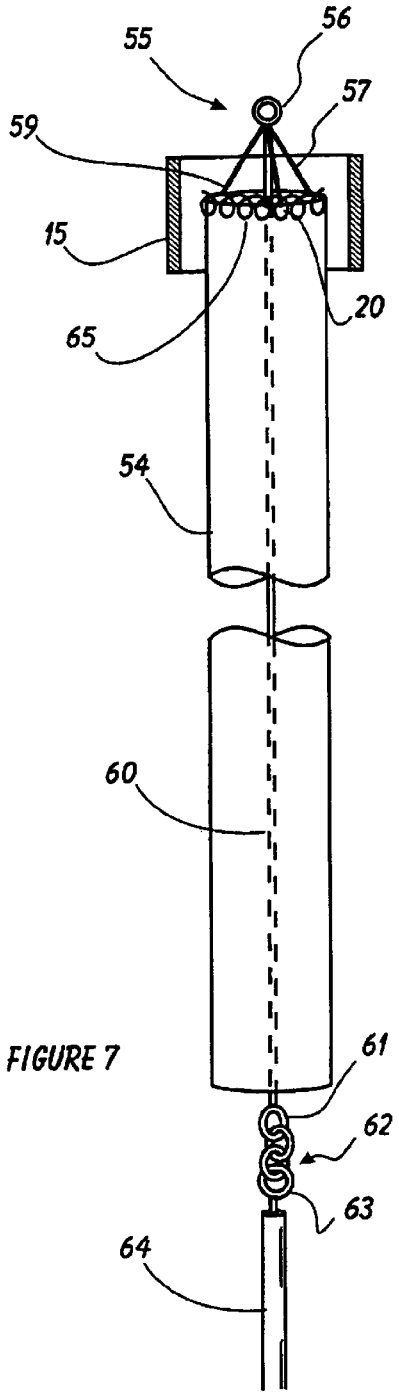
FIG. 7 is a view of the present debris-catching Sample/Junk basket portion of the instant invention shown mounted to the bottom end of the 0.092 diameter support wire with a sixty (60) pound weight attached thereto.

With special emphasis now on FIGS. 3, 6 and 7, the "back-bone" of the present oil well cleaning apparatus 10 and method disclosed herein, is the support wire 8. The support wire 8 typically consists of piano wire having a thickness of approximately 0.092 inches. A Sample/Junk basket 22, as shown in FIG. 3, is attached to the bottom of the piano wire 8. The purpose of the Sample/Junk basket 22 is to collect material flushed in from the surrounding formation, for analysis, while retrieving all other debris, immediately following the ignition and use of the present invention 10 in an oil well bore 12.

Turning now to FIG. 6, there is shown and illustrated the old, prior art type and style of Sample/Junk basket 33. The basket 33 itself is conically shaped, eight (8) inches in diameter (at the top), ten (10) inches high and is constructed of a perforated metal material which acts to retain and hold debris which falls thereunto, but which will allow the liquid substances to generally pass easily therethrough. At the top of the basket 33, is a tri-rod and centered support-bar structure, generally indicated at 34, consisting of a solid metal frame, including a reinforcing ring 35 which is secured to the rim 36 of the basket 33 to both support the basket 33 and to maintain the rim 36 of the basket 33 in a fixed, open position to receive the debris created by the explosive activities of the detonator 18 and the detonating cord 16. Three rod struts 37, 38, and 39 are secured at one of each of their ends 40, 41 and 42 to the reinforcing ring 35. The other ends 43, 44, and 45 of the rod struts 37, 38 and 39, respectively, are joined together at a centered reinforced bar 48. The centered reinforced bar 46 has eyebolts 47 and 50 affixed to each end. The purpose and function of the eyebolts 47 and 50 is to allow the bottom end of the 0.062 diameter guide wire 8 to be secured to the top end of the basket 22 and to secure the bottom end of the basket 22 to the top of the 14 (fourteen) pound weight 53. The 14 (fourteen) pound weight 53 also has an eyebolt 52 its top side. The bottom of the basket 22 and top end of the 14 (fourteen) pound weight 53 are connected with a side nut link 51, so that the basket 33 and 14 (fourteen) pound weight 53 are essentially disposed at the bottom of the 0.062 diameter guide wire 8 as typically shown and illustrated in FIG. 3 in the form of the Sample/Junk basket 22.

In the present invention 10, a newer type and style of Sample/Junk basket 54 is shown and depicted in FIG. 7. This cylindrical basket 54 has a diameter between one (1) inch and three (3) inches, a height of three (3) feet and is formed of a fifty-thousandth ($^{50}/_{1000}$) slot stainless steel screen material and is supported by a combination of a tri-rod 57, 58 and 59 and central support bar 60 assembly, generally indicated at 55. This tri-rod 57, 58, and 59 and central support bar 60 assembly is virtually identical to the top support structure 34 as shown in FIG. 6. This tri-rod assembly 57, 58 and 59 is affixed to the top rim 20 of the Sample/Junk basket 54 at one end, and to the top end of the central support bar 60 at the other. Eye bolts 56 and 61 are connected to the top and bottom end of the support bar 60 which spans through the entire length of the basket 54. An eye bolt 63 affixed to the top of the sixty (60) pound weight 64 is connected to the eyebolt 61 at the bottom end of the basket 54 with a side nut link 62 as shown in FIG. 7

About the top rim 20 of the Sample/Junk basket 54 is a series of flexible metal loops, either formed of a series of individual rings, or, alternatively, from one wire arranged in the form of one continuous series of loops, identified at 65 as a spring-type device for serving both as a very large sieve for retrieving debris, and as a spring biasing means for effectuating self-centering of the entire basket 54 within the oil well casing bore 15 as the basket 54 is raised and lowered inside of the oil well casing bore 15.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

Still further, it will be obvious one skilled in the art herein that various modifications are possible to the preferred embodiment of the invention disclosed herein that fall within the scope of the present invention. For example, other embodiments are possible, incorporating several of the embodiments described hereinabove, and one or more of the devices described hereinbefore can be positioned in one or more boreholes and coupled together to form an explosive and testing system which can be relatively large and complex.

It will also be understood that the invention could be used in any application where a concentrated and controlled source of explosive energy is required or preferred.

What I claim as my invention is:

1. An apparatus for redeveloping and improving the yield of an existing oil well, comprising:

(a) a desensitized, detonating cord, said detonating cord being encased in two layers of PVC material;

(b) a plurality of spaced-apart, elongated metal tubes adapted to be fixedly mounted about said detonating cord wherein said metal tubes are made of steel having a Rockwell hardness of sixty (60) or higher;

(c) means for fixedly securing said metal tubes to said detonating cord with said tubes in spaced relation along said detonating cord;

(d) a support wire longer than the length of said detonating cord; and (e) means for fixedly securing said detonating cord to said support wire.

2. The apparatus of claim 1 wherein said detonating cord has a burn rate of from approximately fifteen thousand (15,000) feet per second to approximately twenty-three thousand (23,000) feet per second.

3. The apparatus of claim 1 wherein said metal tubes have a wall thickness of from approximately one-eight (⅛) inch to one-fourth (¼) inch.

4. The apparatus of claim 1 wherein said metal tubes have a length of from approximately three (3) inches to six (6) inches.

5. The apparatus of claim 1 wherein said means for fixedly securing said metal tubes to said detonating cord is adhesive tape wrapped around said metal tube and said detonating cord.

6. The apparatus of claim 1 wherein a support wire consists essentially of piano wire.

7. The apparatus of claim 6 wherein said piano wire has a nominal diameter of approximately 0.092 inch.

8. The apparatus of claim 1 wherein said means for fixedly securing said detonating cord to said support wire is adhesive tape wrapped around each said metal tube, said detonating cord and said support wire.

9. The apparatus of claim 1 further comprising a plastic tube arranged in adjacent parallel disposition to said detonating cord and said metal tubes, said plastic tube further defined by sealed ends and further filled with a substance for clearing perforations in the casing of an oil well.

10. The apparatus of claim 9 wherein said plastic tube is heat-shrink tubing.

11. The apparatus of claim 9 wherein said plastic tube is PVC tubing.

12. The apparatus of claim 9 wherein said plastic tube is sealed at each said end with a neoprene plug.

13. The apparatus of claim 9 wherein said plastic tube is sealed at both ends by heat-sealing the plastic material.

14. The apparatus of claim 9 wherein said plastic tube is sealed at each said end with an adhesive.

15. The apparatus of claim 9 wherein said plastic tube is arranged in parallel disposition to said detonating cord and said metal tubes and further encases substantially all of said detonating cord and said metal tubes therewithin.

16. The apparatus of claim 9 wherein said substance filling said plastic tube for clearing perforations in the casing of an oil well comprises paraffin dispersents.

17. The apparatus of claim 9 wherein said substance filling said plastic tube is a liquid.

18. The apparatus of claim 9 wherein said substance filling said plastic tube is a granulated substance.

19. The apparatus of claim 18 wherein said granulated substance contains chlorine.

20. The apparatus of claim 9 wherein said substance is acidic.

21. The apparatus of claim 9 wherein said substance is caustic.

22. An apparatus for increasing the permeability of a productive oil formation about an existing oil well bore to stimulate oil extraction therefrom, comprising:

(a) a desensitized detonating cord;

(b) a plurality of hardened steel sleeves disposed in spaced apart relationship about said desensitized detonating cord, said spacing selected to effectuate time sequencing of the detonating cord explosions and the explosive gas propagation/burn rate within the oil well bore;

(c) a detonator for igniting said desensitized detonating cord;

(d) a shield mounted about said detonator for reducing the shock effect of detonating said detonator, while substantially maintaining the kinetic energy produced thereby as it explodes and ignites said desensitized detonating cord;

(e) a support wire to which said detonating cord is secured;

(f) an external plastic tube arranged to be adjacently disposed to said detonating cord, said tube filled with special chemicals such as paraffin dispersants, including non-liquid, granulated chemicals containing chlorine, or the like, whereby ignition of said detonating cord explosively propels said granulated chemicals through the clogged perforations in the oil well casing and into the geologic strata thereabout to chemically react therewith to promote oil flow therethrough by increasing the transmissibility of a productive oil formation;

(g) a sample/junk bucket mounted at the bottom of the support wire; and (h) a weight mounted to the bottom of the sample/junk bucket.

23. The apparatus of claim 22, wherein said shield comprises:

(a) a continuous metal wire having a triangular cross-section arranged in spirally-wound fashion to form a tubular structure with the apex of the triangular cross-section of the wire facing towards the inside of the tubular structure, the tubular structure having a generally circular cross-section with a pair of oppositely-disposed open ends thereto, with each of the completed spiral loops being disposed in spaced apart relationship for the passage of kinetic energy therethrough;

(b) a first metal collar secured about one of the open ends of the tubular structure;

(c) a second metal collar secured about the other of the open ends of the tubular structure; and (d) a plurality of metal strips arranged co-extensively with the length of the tubular structure and disposed in spaced-apart relationship to one another, and each of such metal strips secured to each of the spiral loops to maintain the spaces between each of the spiral loops.

24. The apparatus of claim 22, wherein said detonation cord is disposed inside said external plastic tube.

25. The apparatus of claim 22, wherein said detonation cord is disposed outside of, and in close proximity to, said external plastic tube.

* * * * *